United States Patent [19]

Osher

[11] 4,047,315

[45] Sept. 13, 1977

[54] HOLDER FOR PHOTOS AND THE LIKE

[75] Inventor: Benjamin B. Osher, New York, N.Y.

[73] Assignee: Kleer-Vu Industries, Inc., New York, N.Y.

[21] Appl. No.: 724,256

[22] Filed: Sept. 17, 1976

[51] Int. Cl.[2] ..... B42F 7/12

[52] U.S. Cl. ..... 40/102; 40/104.06; 40/104.19

[58] Field of Search ..... 40/104.06, 104.04, 104.09, 40/102, 104.19, 124.2

[56] References Cited

U.S. PATENT DOCUMENTS

| | | | |
|---|---|---|---|
| 1,710,796 | 4/1929 | Garrow | 40/104.06 |
| 2,096,559 | 10/1937 | Riley | 40/102 X |
| 2,610,421 | 9/1952 | Horn | 40/104.19 X |

OTHER PUBLICATIONS

Hubbard, "Concerning the Kardex", 1921, pp. 9, 19, 20, 21 and 46.

*Primary Examiner*—John F. Pitrelli
*Attorney, Agent, or Firm*—Sherman Levy

[57] ABSTRACT

A holder for photographs and the like is provided that includes a housing or box, a plurality of slidably mounted trays, and a plurality of swingably mounted article holders are pivotally connected to each tray whereby articles such as photographs can be conveniently supported in each of the article holders.

3 Claims, 6 Drawing Figures

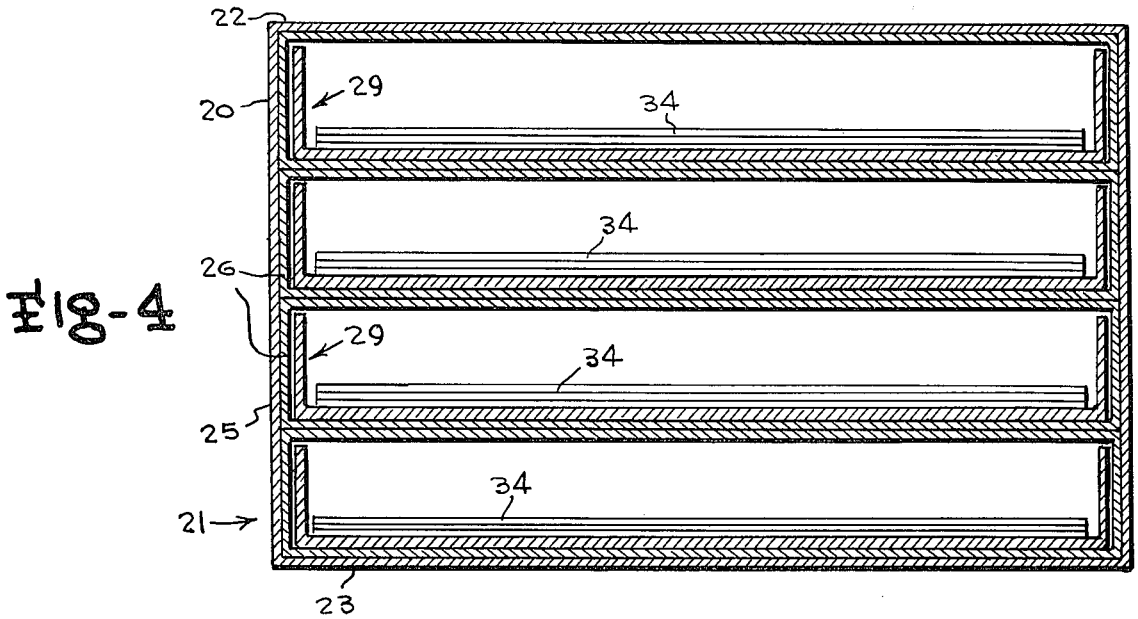
Fig-4
Fig-3
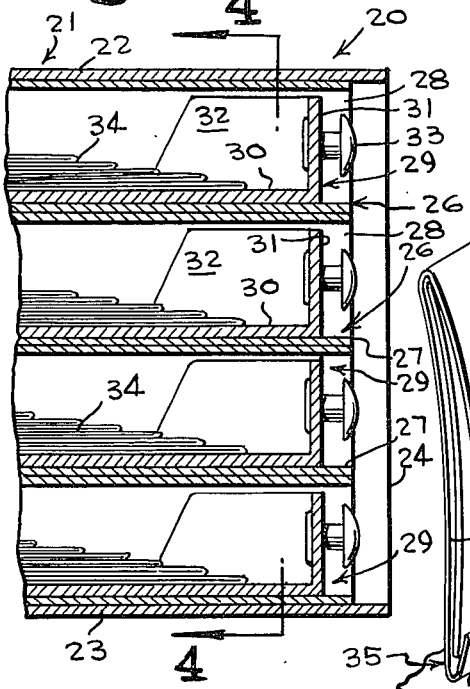
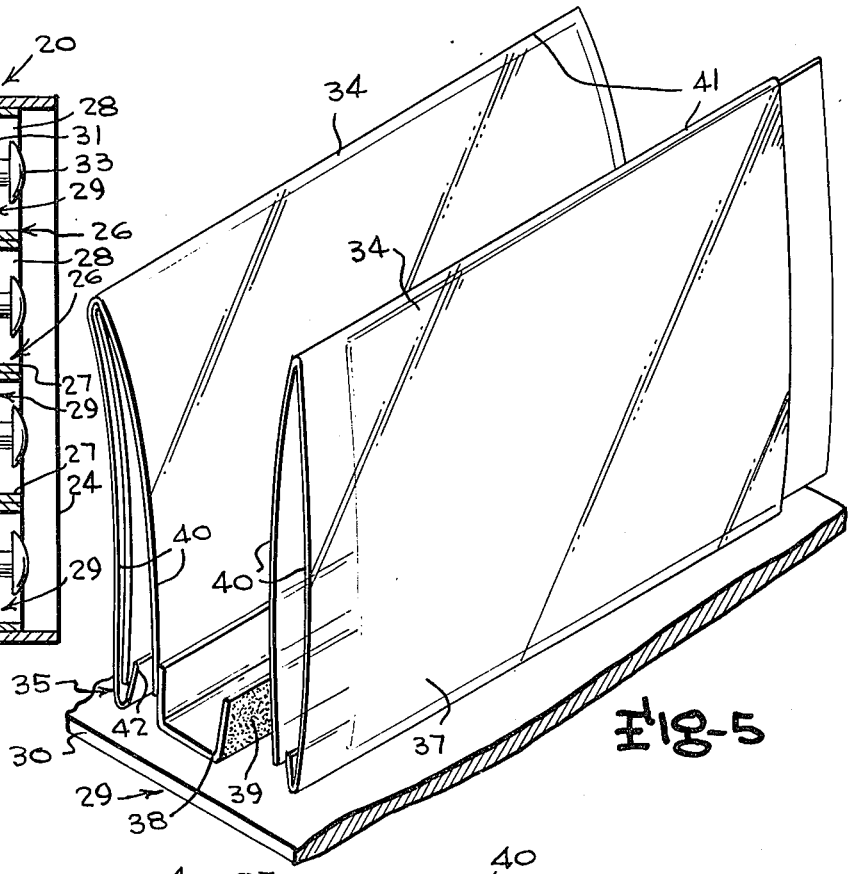
Fig-5
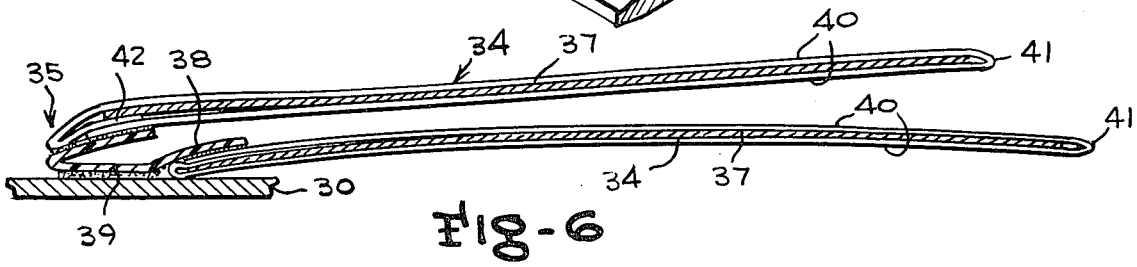
Fig-6

HOLDER FOR PHOTOS AND THE LIKE

BACKGROUND OF THE INVENTION

FIELD OF THE INVENTION

The present invention relates to article holders, and more particularly to holders for articles such as photographs.

In accordance with the present invention a plurality of trays are slidably mounted in a housing or box, and each of the trays has a plurality of photograph holders swingably connected thereto so that the user can conveniently view the photographs or other articles for gain access thereto.

A primary object of the present invention is to provide an article holder for supporting a plurality of articles such as photographs so that the photographs are conveniently mounted and supported and whereby the photographs can be readily removed from or placed in the holders as desired or required.

Still another object of the present invention is to provide a holder for articles such as photographs which is especially convenient for holding a plurality of photographs so that when a person desires to view or gain access to the photographs, it is only necessary to manually extend one or more of the trays whereby flexible holders that are swivelly connected to the trays can be manually engaged.

A still further object of the present invention is to provide a photograph holder that is ruggedly constructed and efficient to use and which is relatively simple and inexpensive to manufaacture.

Still another object of the present invention is to provide a photograph holder that has improved characteristics and advantages as compared to previous article holders.

Other objects and advantages of the present invention will become apparent in the following specification, when considered in the light of the attached drawings.

BRIEF DESCRIPTION OF THE DRAWINGS

FIG. 3 is a longitudinal sectional view taken on the line 3—3 of FIG. 1.

FIG. 4 is a transverse sectional view taken on the line 4—4 of FIG. 3.

FIG. 5 is an exploded perspective view of one dual envelope with the attaching adhesive tape or strip.

FIG. 6 is a transverse section of FIG. 5 assembled and showing the paper inserts.

DESCRIPTION OF THE PREFERRED EMBODIMENT

Figure 1:
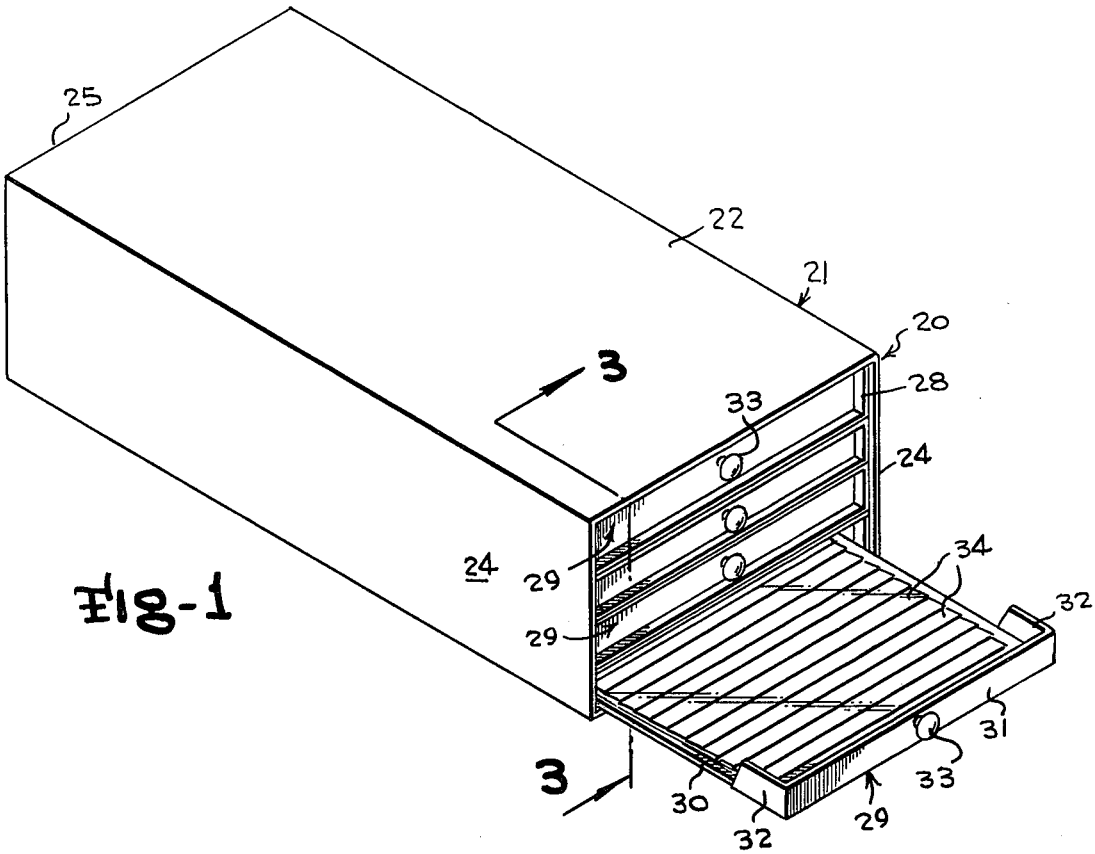
FIG. 1 is a perspective view of the photo cabinet with one tray partially withdrawn.

Referring in detail to the drawings, the numeral 20 indicates the holder for photos and the like of the present invention and includes a housing or hollow box 21; the housing 21 includes spaced parallel horizontally disposed top and bottom walls 22 and 23 as well as vertically disposed spaced parallel side walls 24 and a vertically disposed back wall 25. The front end of the housing 21 is open as shown in the drawings.

Mounted in the housing 21 is a plurality of superimposed stationary guide members 26, and each of the guide members 26 includes horizontally disposed portions 27 that define separators, and the guide members 26 further include vertically disposed side portions 28 that are mounted contiguous to the inner surfaces of the side walls of the housing 21.

A plurality of similar trays 29 are slidably mounted in the guide members 26, FIG. 3, and each of the trays 29 includes a bottom piece 30, a front piece 31, and vertically disposed side pieces 32. Manually engageable knobs 33 are suitably affixed to the front pieces 31 whereby the trays 29 can be conveniently moved in or out of the compartments defined within the hollow guide members 26.

Figure 2:
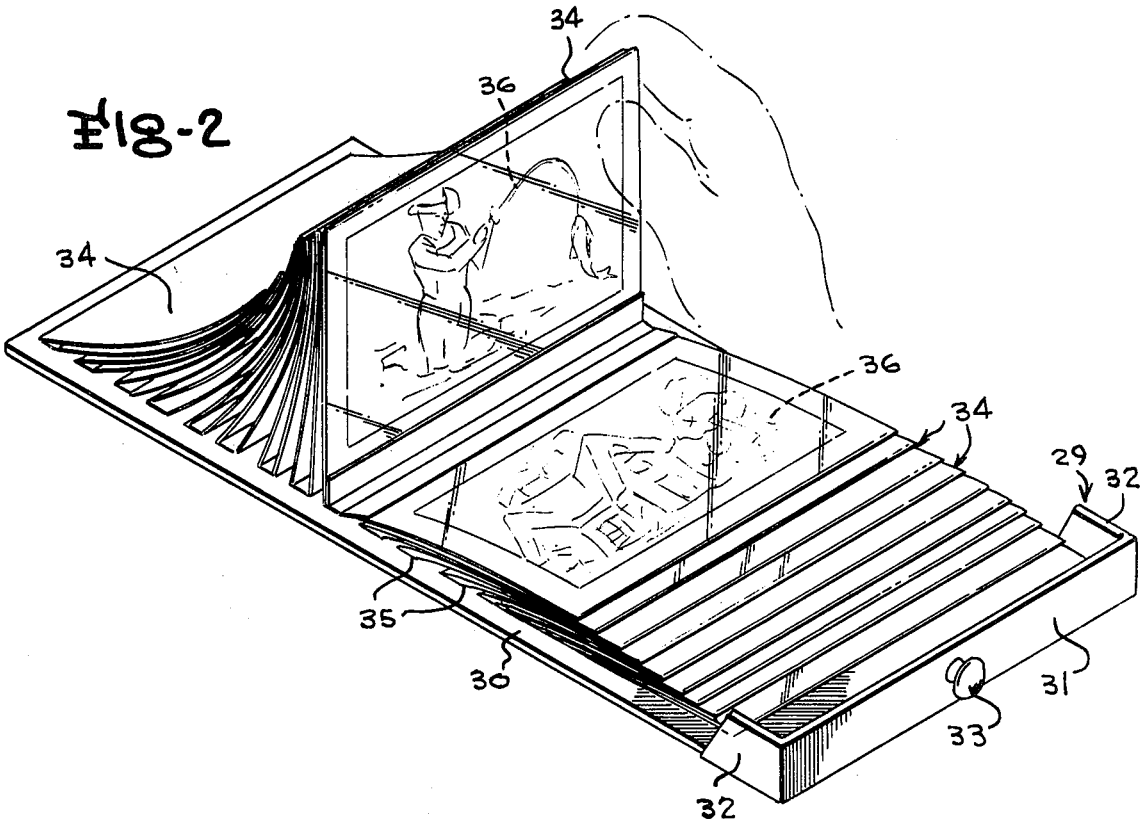
FIG. 2 is a perspective view of a photo tray showing the attachment of the dual photo envelopes.

A plurality of pivotally mounted article holders or envelopes 34 are swivelly connected to the upper surface of the bottom piece 30 of the trays 29, and the aticle holders 34 are adapted to hold or support articles such as photographs 36 therein, FIG. 2. The holders 34 are in the form of dual transparent envelopes so that each of the holders 34 can support a pair of photographs 36 whereby a photograph can be supported adjacent each of the sides of the insert or filler 37. The holders 34 are in horizontally disposed overlapped stepped relation as shown in FIGS. 1 and 3 relative to each other when the trays are in the inward position relative to the housing 21. When the user desires to view the photographs or gain access to the photographs, it is only necessary to manually pull a desired tray outward whereby the envelopes or holders 34 can be swivelled to a generally vertical position as shown in FIG. 2 to permit the user to conveniently look at the pictures or photographs. The opposite side edges of the holders 34 are open so that the photographs can be readily inserted in or removed from the holders 34.

The numeral 35 indicates the means for pivotally mounting the article holders onto the base piece 30 of the trays 29 and this means comprises plastic strips or tapes 38 that have adhesive 39 thereon, FIG. 6. Transparent flexible plastic sheets 40 are mounted on the paper fillers or inserts 37 and the outer edges of the transparent sheets 40 are closed as at 41, while the opposite end portion 42 of the transparent material 40 is arranged in overlapped relation and is adhesively affixed to the strip 38 by means of the adhesive 39.

From the foregoing, it will be seen that there has been provided a holder for photos and the like, and in use with the parts as shown in the drawings, a plurality of the trays 29 are conveniently slidably mounted in the housing 21. When the device is not being used, the various trays 29 are in a retracted or closed position within the box or housing 21 so that the entire unit occupies a small amount of space for storage or shipment. When it is desired to gain access to any of the photographs 36 or the holders 34, it is only necessary to manually grasp a knob 33 and pull the desired tray 29 outwardly as shown, for example, in FIG. 1, and then the holders 34 can be pivoted upwardly so that the photographs or other articles 36 can be conveniently viewed through the transparent sheeting 40. The pivot mounting 35 consists of the strips 38 which are adhesively held in place as at 39, and the adhesive 39 also attaches end portions of the holders 34 to free edge portions of the strips 38.

The parts can be made of any suitable material and in different shapes or sizes as desired or required.

The inserts 37 are adapted to be made of a suitable material such as paper so as to provide the desired rigidity or stiffness for the flexible transparent plastic sheets 40. By means of the present invention, a plurality of photographs can be conveniently stored or mounted in a compact unit whereby such photographs are readily available when the user desires to observe the same.

Additional embodiments of the invention in this specification will occur to others and, therefore, it is intended that the scope of the invention be limited only by the appended claims and not by the embodiments described hereinabove. Accordingly, reference should be made to the following claims in determining the full scope of the invention.

What is claimed is:

1. Apparatus for holding a plurality of thin articles including photographs in a manner to be selectively displayed comprising, an elongated housing having top and bottom walls connected by generally parallel side walls and a back wall, the front end of said housing being open, a plurality of elongated superimposed stationary guide members mounted in stacked abutting relationship with each other within said housing in a position to reinforce the same, each of said guide members including upper and lower horizontally disposed portions and vertically disposed side portions, said side portions being in abutting relationship with said side walls of said housing, said guide members extending substantially the entire length of said housing, a tray slidably mounted in each of said guide members, each of said trays including a bottom piece substantially complementary to said horizontally disposed portions of said guide members, each of said trays having a front piece extending upwardly from the front edge of said bottom piece and a pair of side pieces extending rearwardly a short distance from said front piece along each side of said bottom piece, said front pieces closing the open end of said housing, means carried by each tray for withdrawing the tray from its associated guide member, a plurality of flat tubular transparent article holders, tape means hingedly mounting a plurality of pairs of holders on said bottom piece, said pairs of holders being in generally parallel relationship with each other and with said front piece, one edge of each of said holders being positioned adjacent to said bottom piece, the holder nearest to said front piece being spaced rearwardly therefrom a distance greater than the length of said side pieces so that articles may be slid into said holders, and said articles holders being arranged in generally horizontally disposed overlapping relationship with each other when said trays are in retracted position within said housing.

2. The structure as defined in claim 1, including filler means disposed within each of said article holders.

3. The structure as defined in claim 1, in which said article holders extend substantially entirely across said botttom piece.

* * * * *